US007574995B2

(12) United States Patent
Graham

(10) Patent No.: US 7,574,995 B2
(45) Date of Patent: Aug. 18, 2009

(54) FUEL INJECTION SYSTEM

(75) Inventor: Mark S. Graham, Midhurst (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/983,242

(22) Filed: Nov. 8, 2007

(65) Prior Publication Data

US 2008/0154479 A1 Jun. 26, 2008

(30) Foreign Application Priority Data

Nov. 8, 2006 (EP) ..... 06255733

(51) Int. Cl.
*F02M 37/04* (2006.01)
*F02M 37/14* (2006.01)

(52) U.S. Cl. ..... 123/506; 123/456

(58) Field of Classification Search ..... 123/456, 123/447, 446, 467, 468, 469, 506
See application file for complete search history.

(56) References Cited

U.S. PATENT DOCUMENTS 5,511,528 A 4/1996 Iwanaga et al.
6,065,436 A * 5/2000 Koga et al. ..... 123/179.17
6,694,952 B1 * 2/2004 Yamazaki et al. ..... 123/496
6,701,898 B2 * 3/2004 Tokuo et al. ..... 123/456
6,725,837 B2 * 4/2004 Hiraku et al. ..... 123/436
2002/0033167 A1 * 3/2002 Hiraku et al. ..... 123/456
2003/0164161 A1 * 9/2003 Usui et al. ..... 123/510
2004/0055580 A1 * 3/2004 Yamada et al. ..... 123/495

FOREIGN PATENT DOCUMENTS

| | | |
|---|---|---|
| DE | 10233101 | 1/2004 |
| EP | 0909892 | 4/1999 |
| EP | 1316718 | 6/2003 |
| WO | 2005/124145 | 12/2005 |

* cited by examiner

*Primary Examiner*—Mahmoud Gimie
(74) *Attorney, Agent, or Firm*—Thomas N. Twomey

(57) ABSTRACT

A fuel injection system for an internal combustion engine, comprises: a pump comprising a pumping plunger which is driven, in use, to cause pressurization of fuel within a pump chamber, an accumulator volume for supplying fuel to a fuel injector, a fuel passage providing fluid communication between the pump chamber and the accumulator volume, and an inlet control valve operable to control fuel flow into the pump chamber from a low pressure reservoir; wherein the inlet control valve is a latching inlet valve. The fuel injection system may be a hybrid fuel injection system, having a rail valve located in the fuel passage between the pump chamber and the accumulator volume. The latching inlet valve may be a two-way electronic latching poppet valve, and the rail valve may be a non-return valve. A method of operating such a fuel injection system for an internal combustion engine is also described.

19 Claims, 3 Drawing Sheets

– PRIOR ART –

- PRIOR ART -

FUEL INJECTION SYSTEM

This invention relates to a fuel injection system for an internal combustion engine. In particular, the invention relates to a fuel injection system including a latching valve for the metering of low-pressure fuel entering the injection system.

A so-called Electronic Unit Injector (EUI) includes a dedicated pump having a cam-driven plunger for raising fuel pressure within a pump chamber, and an injection nozzle through which fuel is injected into an associated engine cylinder. A spill valve is operable to control the pressure of the fuel within the pump chamber. When the spill valve is in an open position, the pump chamber communicates with a low pressure fuel reservoir so that fuel pressure within the pump chamber is not substantially affected by movement of the plunger and fuel is simply drawn into and displaced from the pump chamber as the plunger reciprocates. Closure of the spill valve causes pressure in the pump chamber to rise as the plunger is driven to reduce the volume of the pump chamber. Thus, in an EUI the pump and the fuel injection nozzle are housed in the same unit.

In some EUIs, in order to control the timing of commencement and termination of the injection of fuel, especially relative to the operation of the spill valve, the fuel injector is provided with an injector (or nozzle) control valve, which controls the movement of a fuel injector valve needle relative to a valve seating and, thus, the delivery of fuel from the injection nozzle to an engine cylinder. Such EUIs are commonly known as two-valve EUIs.

It is also known for fuel injection systems other than EUIs to have an electronically controlled injector control valve for controlling the timing of the fuel injection event. Such fuel injectors may be termed "smart" injectors.

Typically, the engine is provided with a plurality of such fuel injection systems, for example, a plurality of one or two-valve EUIs, one for each cylinder of the engine.

Although the use of an injector (or nozzle) control valve in an EUI provides a capability for controlling the injection timing, and such units are capable of achieving high injection pressures, both injection pressure and injection timing are limited to some extent by the nature of the associated cam drive.

In common rail fuel injection systems, a single pump is arranged to charge an accumulator volume (or common rail), with high-pressure fuel for supply to a plurality of injectors of the fuel system. As in a two-valve EUI, the timing of injection is controlled by means of an injector control valve associated with each injector. One advantage of the common rail system is that the timing of injection of fuel at high pressure is not dependent upon a cam drive, and so the flexibility of injection timing is good. However, achieving very high injection pressure within a common rail system is problematic and requires a dedicated high-pressure pump of significant cost.

Recognising that both EUI and common rail systems have certain disadvantages, in granted U.S. Pat. No. 7,047,941 (Delphi Technologies Inc.) the Applicant has previously proposed a hybrid EUI-common rail fuel injection system which combines the functionality and benefits of both types of system, whilst avoiding several of the drawbacks of each of them.

The hybrid system of U.S. Pat. No. 7,047,941 includes a common rail fuel pump that supplies fuel at a moderately high and injectable first pressure level (e.g. 300 bar) to a common rail, and a second pump arrangement that supplies fuel to a dedicated fuel injector at a second pressure level. The common rail and the pump chamber of the second pump arrangement are separated by a first fuel supply passage that is controlled by a rail control valve. This system has two key modes of operation: (1) if the rail control valve is closed, the second pump arrangement causes fuel within its respective pump chamber (which is initially at a relatively low level), to be increased to a variable, higher pressure level (the second pressure level). Fuel at the second pressure level is then delivered through a second supply passage to a fuel injector and is ultimately delivered to the engine under the control of an injector control valve; (2) if the rail control valve is open, the action of the second pump arrangement has no pressurising effect on fuel within its pump chamber and so fuel is delivered to the injector at the first (common rail) pressure level. Thus, by controlling the status of the rail control valve it is possible to vary the fuel injection pressure between first and second pressure levels.

Co-pending patent application GB 0614537.9 (Delphi Technologies, Inc.), the contents of which are incorporated herein by reference, describes an improved hybrid fuel injection system.

In this improved hybrid fuel injection system, a pumping plunger is movable within a housing unit to cause pressurisation of fuel within a pump chamber, and an accumulator volume (e.g. a common rail) is arranged to supply fuel to a fuel injector. A fuel passage provides communication between the pump chamber and the accumulator volume, and a non-return valve within the fuel passage, upstream of the fuel injector, regulates the flow of fuel between the two volumes. In addition, a spill valve is operable to control fuel flow into and out of the pump chamber.

This system provides a number of advantages over the prior art (e.g. known hybrid common rail-EUI systems). One such advantage is the fact that the pump chamber and the spill valve are isolated, by means of the non-return valve, from the high-pressure fuel source (the common rail) for most of the pumping stroke. Accordingly, high-pressure fuel leakage (e.g. through the plunger bore and the spill valve) is reduced.

However, despite the above-mentioned advantages, the filling/metering of prior art hybrid fuel injection systems (also known as "distributed pump common rail (DPCR) systems), including that of GB 0614537.9, through the use of a traditional two-way spill valve, has a number of disadvantages.

(i) Hole and gallery intersections within the spill valve body experience the maximum system fuel pressure, which causes high stresses, and means that this part is more prone to fatigue failure.

(ii) When fuel pressure in the pump chamber is elevated above the system motoring pressure, leakage can occur within the spill valve as high-pressure fuel escapes to low pressure past the valve pin stem.

(iii) Since the leakage of the spill valve referred to in point (ii) above is governed by the clearance between the spill valve pin and the spill valve guide, a tightly controlled 'match ground' finish on both parts is required to reduce leakage. This machining requirement adds a significant manufacturing cost to the parts.

(iv) The small clearance between the valve pin and valve guide, mentioned in part (iii) above, increases the friction between the two parts, and this can result in "sticking" of the parts. Such sticking can lead to inconsistencies between injector units, which can affect engine performance.

(v) Closure of the electronically-operated spill valve, so that pumping into the common rail system can take place, requires a current to be drawn though the valve stator for the entire duration that the valve is closed. The duration of this 'hold' current places a large demand on the engine ECU and can even lead to overheating of the valve.

(vi) Whilst in the closed state, a sudden change in fuel pressure within the pump chamber or common rail can cause the spill valve to open ("blow off"), which leads to a failure of the unit to pressurise fuel to the desired level.

The present invention aims to overcome or alleviate some of the problems associated with the prior art.

Thus, in accordance with a first aspect of the invention, there is provided a fuel injection system for an internal combustion engine, the fuel injection system comprising: a pump comprising a pumping plunger which is driven, in use, to cause pressurisation of fuel within a pump chamber, an accumulator volume for supplying fuel to a fuel injector, a fuel passage providing fluid communication between the pump chamber and the accumulator volume, and an inlet control valve operable to control fuel flow into the pump chamber from a low pressure reservoir; wherein the inlet control valve is a latching inlet valve.

The latching inlet valve is may be a two-way electronic latching poppet valve. This offers the further advantage that the timing of the closing of the valve can be chosen as desired.

It is known to use a latching valve in a fuel injection system from U.S. Pat. No. 6,530,363. However, in this system the latching valve does not function to meter the delivery of fuel from a low pressure reservoir into the pump chamber.

The fuel injection system may be an electronic unit pump (EUP) in which the pump elements are separated from an injector by a fuel pipe. Accordingly, the fuel injection system of the invention may be provided, as stated above, without an injector unit. However, the fuel injection system may alternatively be an EUI in which the pump elements and the injector are formed in a common unit. In some embodiments, therefore, the fuel injection system of the invention may further comprise a fuel injector; and suitably in such embodiments, the fuel injection system is an EUI.

The fuel injection system of the invention has a number of advantages over the prior art. For instance, the invention provides the advantage that the fuel delivery intersections within the control valve guide of the latching inlet valve can remain at the pressure of the low-pressure reservoir throughout the complete cycle of the EUI or EUP. Elimination of high pressure at these intersections can lead to a significant manufacturing cost reduction and a reduction in the risk of fatigue failures in the inlet control valve.

It is a further advantage of the invention that when the latching inlet valve is closed, the high-pressure acting on the pump side of the valve will act to close the valve and thereby reduce the likelihood of fuel leakage across the valve to low pressure.

Thus, as described with reference to FIG. 3, the physical construction of the latching valve means that the (region around the) valve stem always experiences low pressure, because, when the valve is closed, the valve intersection is isolated from high pressure by the interaction of the valve seating surface with the valve seat. In contrast, in the spill valve arrangements of the prior art the valve stem is always exposed to high pressure, so there is a constant risk of fuel leakage to low pressure through the region between the valve stem and the valve guide.

Accordingly, a further advantage is apparent with respect to the manufacture of the fuel injection system of the invention. Since any fuel leakage is not governed by the clearance between the stem of the inlet control valve and the valve guide (or housing bore), then a looser fit between these two components is acceptable. The associated reduction in machining requirements provides a significant cost saving over the prior art systems.

A further advantage of the invention is that because the latching valve is unbalanced (i.e. one end is exposed to high-pressure and one end is exposed to low-pressure), when the pressure within the pump chamber is greater than that of the low-pressure fuel reservoir, it will assist in positively loading the valve seat of the latching valve and maintaining an effective seal. Since high-pressure fuel acts on the valve to maintain its closed state, after the stator has been energised and the latching valve is seated, the power input to the stator can be removed. Thus, compared with the prior art, the energy required to operate effectively the fuel injection system of the invention is reduced.

It is further expected that the reduced power requirements of the stator of the latching valve used in accordance with the invention will lead to less demand on the ECU and less heat generation within the stator.

Therefore, in an advantageous mode of operation, energisation of the stator is not required for the complete duration of the closed state of the latching valve.

Thus, in accordance with a second aspect of the invention, there is provided a method of operating a fuel injection system for an internal combustion engine comprising a latching inlet valve operable to control fuel flow into a pump chamber from a low pressure reservoir, a pumping plunger for performing a pumping cycle consisting of a pumping stroke during which the pumping plunger is driven to reduce the volume of a pump chamber and a return stroke during which the pumping plunger is retracted to increase the volume of the pump chamber, the method comprising: operating the latching inlet valve so that it is open during at least a portion of the return stroke so as to allow fuel to flow from the low pressure reservoir into the pump chamber for pressurisation of the pump chamber, and so that it is closed during at least a portion of the pumping stroke so as to cause pressurisation of fuel within the pump chamber; wherein to close the latching inlet valve an energy input is provided and maintained for at least a first period of the pumping stroke and the latching inlet valve remains closed after termination of the energy input for at least a second period of the pumping stroke.

The latching inlet valve comprises a biasing arrangement (e.g. in the form of a spring) that exerts a biasing force x, which tends to open the latching valve. The biasing force x is typically a constant force (i.e. of the same magnitude and/or operable for the entire duration of the pumping cycle), and is suitably exerted directly onto the valve stem of the latching inlet valve.

Advantageously, the energy input is triggered by an electrical signal and the latching inlet valve is an electronic latching valve. Accordingly, closure of the latching valve is suitably caused by energising the stator of an electronic latching valve, which generates a closing force z that is greater than the biasing force x tending to open the latching valve.

More advantageously, so as to reduce the energy requirements of the fuel injection system, the fuel pressure within the pump chamber is used to provide an additional closing force y on the inlet control valve, and the energy input to the latching inlet valve is maintained at least until the closing force y is greater than the (internal) biasing force x tending to open the latching inlet valve.

As will be appreciated by the person of skill in the art, the above methods of operating a fuel injection system are applicable to any of the embodiments of the invention described herein.

Yet another advantage of the invention is that any large or sudden increases in the pressure within the plunger chamber or the accumulator volume should not cause the inlet control valve to open. In the prior art systems, however, any such pressure surges can cause the unintentional opening of the spill valve, which causes depressurisation of the pump chamber.

Further advantages of the invention are apparent when the fuel injection system and the methods for its operation described herein are combined with the hybrid fuel injection system described in GB 0614537.9.

For example, the fuel injection system of GB 0614537.9 is compatible with existing engine installations designed for EUIs as the injector and the pumping plunger (together with the fuel passage between them) are accommodated within the same housing unit. It is therefore possible for engine manufacturers to use existing production line facilities designed for engines with EUI systems without the need to re-tool, whilst at the same time providing an engine to the end user that also has the benefits of a common rail system. By way of example, injection timing in such a system is not dependent on the nature of the cam drive, but can be independent of this due to the presence of the common rail accumulator volume. The timing of injection is therefore much more flexible.

Advantageously, the injector component of the system is in close proximity to the pumping element of the system (i.e. the two are located within the same housing, or are located in immediately adjacent housing parts forming a common housing unit), and therefore, pressure wave effects, which can otherwise adversely affect performance, are minimised.

Moreover, such a system does not require a separate and dedicated high-pressure pump to supply pressurised fuel to the common rail as the pumping arrangement of the system provides this function itself.

Advantageously, the fuel injection system of the invention further comprises a rail valve located in the fuel passage between the pump chamber and the accumulator volume. Beneficially, the rail valve is a non-return valve for regulating the flow of fuel, as in co-pending patent application GB 0614537.9. This has the above-mentioned benefits of further reducing the stresses on the latching valve, by reducing the high fuel pressure that is experienced by the valve. The rail control valve may also be electronically controlled, where it is beneficial to control fluid communication between the pump chamber and the accumulator volume.

In a further embodiment, the fuel injector of the fuel injection system is supplied with fuel via an injector inlet passage that communicates with the fuel passage at a position between the rail valve and the accumulator volume.

The injector is suitably an electronically controlled injector; i.e. having an electronically controlled injector control valve, for controlling fuel injection into the engine. The injector may include a three-way injector control valve for controlling movement of an injector valve needle. In the alternative, however, the injector within may include a two-way injector control valve.

Conveniently, the fuel injector, the pump, and the fuel passage providing fluid communication between the pump chamber and the accumulator volume may be located within the same housing unit, such that the system can be readily installed into existing engine housings. In such embodiments, however, the housing unit may comprise or consist of two (immediately) adjacent housing parts, one of which housing parts contains the pump and one of which housing parts contains the fuel injector. In such embodiments the housing parts although formed separately can be readily connected and/or installed adjacently in an engine.

In another beneficial embodiment, the fuel injection system includes at least one restriction (e.g. in the form of a small orifice) in the fuel passage between the pump chamber and the accumulator volume. In embodiments having a rail valve in the fuel passage between the pump chamber and the accumulator volume, the at least one restriction is located between the rail valve and the accumulator volume. The presence of the at least one restriction offers the advantage that, when the plunger is pumping, it allows the fuel injector to experience a higher pressure than the fuel pressure inside the rail. Thus, with a rail pressure of approximately 1000 bar, for example, the injection pressure could be as high as 2000 bar or more, provided that the pumping event is synchronised with the desired injection timing. Accordingly, this arrangement provides a degree of variation of the injector pressure with engine speed.

By way of example, the restriction may be located approximately at the outlet of the accumulator volume. Advantageously, in these embodiments the rail valve is a non-return valve.

By way of further example, the system may comprise an injector inlet passage (i.e. a fuel supply passage to the injector) for receiving fuel from the fuel passage and through which fuel is delivered to the injector, wherein the restriction is located in the fuel passage immediately upstream of a point of communication/interconnection between the injector inlet passage and the fuel passage.

In a first mode of operation, a control method for a fuel injection system of the invention includes: driving the pumping plunger by means of a cam having a cam nose with a rising flank and a falling flank, wherein the rising flank corresponds to at least a portion of a pumping stroke of the plunger pumping cycle during which the pumping plunger is driven to reduce the volume of the pump chamber and the falling flank corresponds to at least a portion of a return stroke of the plunger pumping cycle during which the pumping plunger is retracted from the pump chamber to increase the volume of the pump chamber; and operating the latching valve so that it is open during at least a portion of the return stroke so as to allow fuel to flow into the pump chamber for pressurisation, and so that it is closed during at least a portion of the pumping stroke so as to cause pressurisation of fuel within the pump chamber. The latching valve may remain closed at the end of the pumping stroke until the plunger has ridden over the cam nose. This mode of operation can be desirable because it provides an advantage in terms of energy conservation and also in terms of audible noise level.

It can, however, also be desirable to maintain the latching valve in its closed state during at least a part of the return (filling) stroke of the plunger. This mode of operation 'pulls a cavity' in the pump chamber, which collapses during the pumping stroke. Thus, in a second mode of operation, the stator is energised (and the latching inlet valve closed) during at least a part of the filling stroke; and, therefore, the latching valve latches later in the pumping stroke when the pressure of fuel in the pump chamber is sufficient to overcome the biasing force of the latching valve. In this mode of operation the stator may, in fact, be closed for the majority of the return (filling) stroke of the plunger. This is a slightly noisier mode of operation than the alternative mode in which the latching valve is only closed during a period of the pumping stroke as the collapse of the cavity (air bubbles) can cause a popping noise.

In the above modes of operation, the stator of the latching valve is energised so as to trigger the closure of the latching valve and allow the pressurisation of fuel within the pump chamber. Thereafter, during the pumping stroke of the pumping plunger the pressure of the fuel within the pump chamber, which communicates with one end of the latching valve, exceeds the pressure of fuel in the low-pressure fuel reservoir. During this period the latching valve experiences a positive closing force from the high-pressure fuel, which means that the stator of the latching valve can be de-energised without causing the latching valve to open.

Therefore, in one mode of operation, the stator of the latching valve is de-energised during at least a period of the time that the latching valve is closed. By way of example, the stator may be de-energised for at least 25% of the time that the latching valve is closed. In another embodiment, the stator may be de-energised for at least 70% or 80% of the time during which the valve is closed; and advantageously, the stator may be de-energised for at least 85, 90% or 95% of the time during which the valve is closed. Thus, it follows that power may be delivered to the stator for as little as 30%, 20%, 15%, 10% or even 5% of the time during which the latching valve is closed. This offers a significant advantage over the prior art both in terms of energy saving and component lifespan.

In the second mode of operation described above, the latching valve is closed for at least a part of the return stroke of the plunger. Therefore, the stator of the latching valve is energised for up to 40%, 50% or 60% of the time during which the valve is closed. In this mode of operation, the stator may even be energised for up to 70, 75% or 80% of the time during which the valve is closed.

The present invention will now be described, by way of example only, with reference to the following figures in which.

Figure 1:
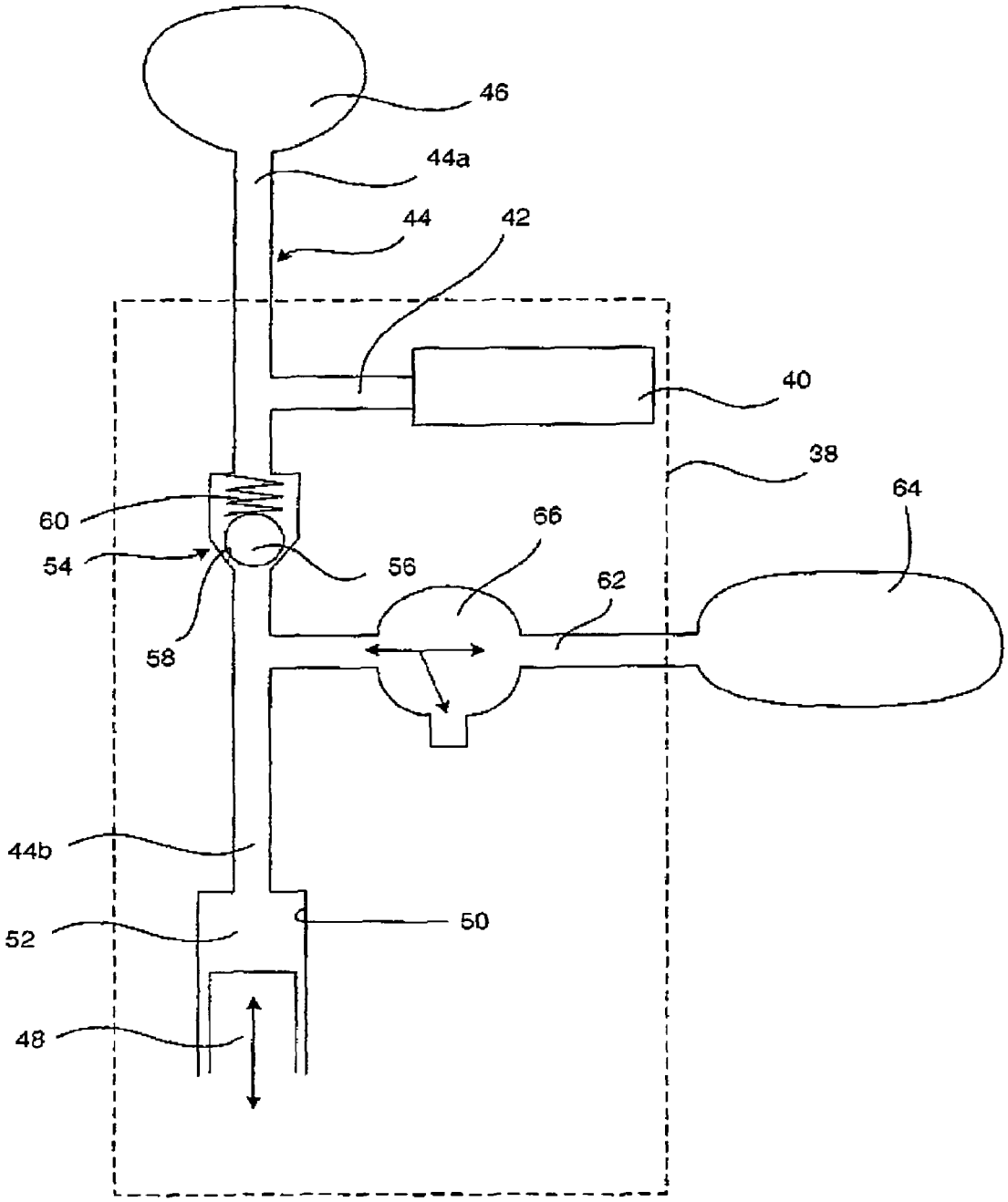
FIG. 1 is a schematic diagram of a first embodiment of the hybrid fuel injection system described in GB 0614537.9.

Referring to FIG. 1, a fuel injection system includes an injector 40, which is supplied with fuel via an injector inlet passage 42. The injector inlet passage 42 receives fuel from a fuel passage 44, which communicates, at one end 44*a*, with an accumulator volume in the form of a common rail 46.

The injector 40 is housed within an injector housing 38, indicated generally by the dashed line. The injector 40 is not shown in detail, but typically includes an injector valve needle (not shown), which is movable towards and away from an injector valve seat, to control the delivery of fuel from the injector 40 into the associated engine cylinder. To control opening and closing of the injector valve needle, an injector control valve (also not shown) is provided which controls the pressure of fuel supplied to the back of the valve needle (i.e. the end remote from the injector valve seat).

The fuel injection system further includes a pump arrangement that is arranged within the injector housing 38, together with the injector 40. The pump arrangement includes a pumping plunger 48 which is movable within a bore 50 provided in the injector housing 38 so as to cause, in certain circumstances, pressurisation of fuel within a pump chamber 52 formed at one end of the bore 50. The pumping plunger 48 is driven by means of a drive arrangement (not shown), which includes an engine driven cam having one or more cam lobes.

The pump chamber 52 communicates with a second end 44*b* of the fuel passage 44 remote from the common rail 46. A non-return valve 54 is located within the fuel passage 44 so that the common rail 46 communicates with the pump chamber 52 via the non-return valve 54. The non-return valve 54 includes a ball 56, which is biased against a valve seat 58 by means of a spring 60. The biasing force of the spring 60 sets an opening pressure for the valve at which the ball 56 is caused to lift from its seat 58 to allow the pump chamber 52 to communicate with the common rail 46, and ensures the valve remains on its seat when there is no pressure in the system.

A pump supply passage 62 branches from the fuel passage 44, on the pump chamber side of the non-return valve 54, and allows fuel from a low-pressure fuel reservoir 64, located external to the injector housing 38, to flow into the pump chamber 52. The injector supply passage 42 branches from the fuel passage 44 on the common rail side of the non-return valve 54 (i.e. on the other side of the non-return valve 54 to the pump supply passage 62). The pump supply passage 62 is provided with an electronically controlled valve 66, (typically referred to as a "spill valve"), which is operable between an open state, in which fuel is able to flow into the pump chamber 52 from the low-pressure fuel reservoir, and a closed state in which communication between the low-pressure fuel reservoir 64 and the pump chamber 52 is broken.

As the injector 40 and the pump arrangement form part of a common unit 38, they can be positioned in an engine in the same way as a conventional EUI with the tip of the injector 40 (referred to as the nozzle) protruding into the associated engine cylinder in a conventional way.

Typically the prior art fuel injection system depicted in FIG. 1 will be operated in the following manner.

In use, the pumping plunger 48 is driven to perform a pumping cycle consisting of: a return stroke, in which the pumping plunger 48 is withdrawn from the bore 50 to expand the volume of the pump chamber 52; and a pumping stroke, in which the pumping plunger 48 is driven into the bore 50 so as to reduce the volume of the pump chamber 52.

In a first mode of operation, initially the spill valve 66 is open so that as the pumping plunger 48 performs its return stroke, fuel is drawn through the pump supply passage 62, through the open spill valve 66 and into the pump chamber 52. Once the pumping plunger 48 has completed its return stroke, so that the pump chamber 52 is filled with low-pressure fuel, it commences its pumping stroke. At an appropriate point in the pumping stroke, the spill valve 66 is closed to prevent further communication between the low-pressure fuel reservoir 64 and the pump chamber 52. By holding the spill valve 66 open for an initial period of the plunger pumping stroke, a proportion of fuel that is drawn into the pump chamber 52 during the return stroke is dispelled through the open spill valve 66, back to the low-pressure reservoir 64, before pressurisation within the pump chamber 52 commences. Continued motion of the pumping plunger 48 through its pumping stroke results in fuel within the pump chamber 52 being pressurised to a high level.

Once fuel pressure in the pump chamber 52 exceeds that within the common rail 46, the non-return valve 54 is caused to open, against the spring force, to allow pressurised fuel in the pump chamber 52 to flow to the common rail 46. The flow of fuel continues until the pumping plunger 48 is at its minimum volume at the top of its stroke. The pumping plunger 48 rides over the nose of the cam and, as it starts its return stroke, the pressure in the pump chamber 52 gradually starts to reduce. Eventually, part way through the return stroke, the pressure in the common rail 46 will exceed that in the pump chamber 52 and the non-return valve 54 will be caused to close under the force of the biasing spring 60 so that communication between the pump chamber 52 and the common rail 46 is broken. High-pressure fuel then remains trapped in the common rail 46.

Once fuel pressure in the pump chamber 52 has reduced to a low level and the non-return valve 54 has closed to trap high-pressure fuel in the common rail 46, the spill valve 66 is opened once more to allow communication between the low-pressure fuel reservoir 64 and the pump chamber 52 and, hence, the next filling cycle commences. The spill valve 66 is opened just after the pumping plunger 52 has passed over the nose of the cam lobe, at the start of the return stroke. Holding the spill valve 66 closed until the plunger 48 rides over the cam nose has been found to benefit energy conservation and audible noise levels.

With the common rail 46 charged with high-pressure fuel, the injector 40 can then be operated so as to inject fuel into the engine cylinder. Injection is initiated by operating the injector control valve so as to cause the valve needle of the injector to lift away from the injector valve seat. Fuel in the common rail 46 is delivered through the fuel passage 44 to the injector inlet passage 42, and hence to the injector, but is unable to return to the pump chamber 52 due to the closed non-return valve 54.

In a second mode of operation, rather than holding the spill valve 66 closed as the plunger rides over the cam nose, the spill valve 66 may be re-opened at the end of the pumping stroke so as to reduce Hertz stresses on the cam. In this mode of operation, the spill valve 66 may be closed relatively early in the pumping stroke, just after bottom-dead-centre and earlier on the accelerating part of the cam.

In a third mode of operation, the spill valve 66 may be closed part way through the return stroke of the pumping plunger 48 so as to control the quantity of fuel that is actually drawn into the pump chamber 52 (i.e. part-filling of the pump chamber 52) for pressurisation. In this mode of operation the spill valve therefore provides an inlet metering function.

Figure 2:
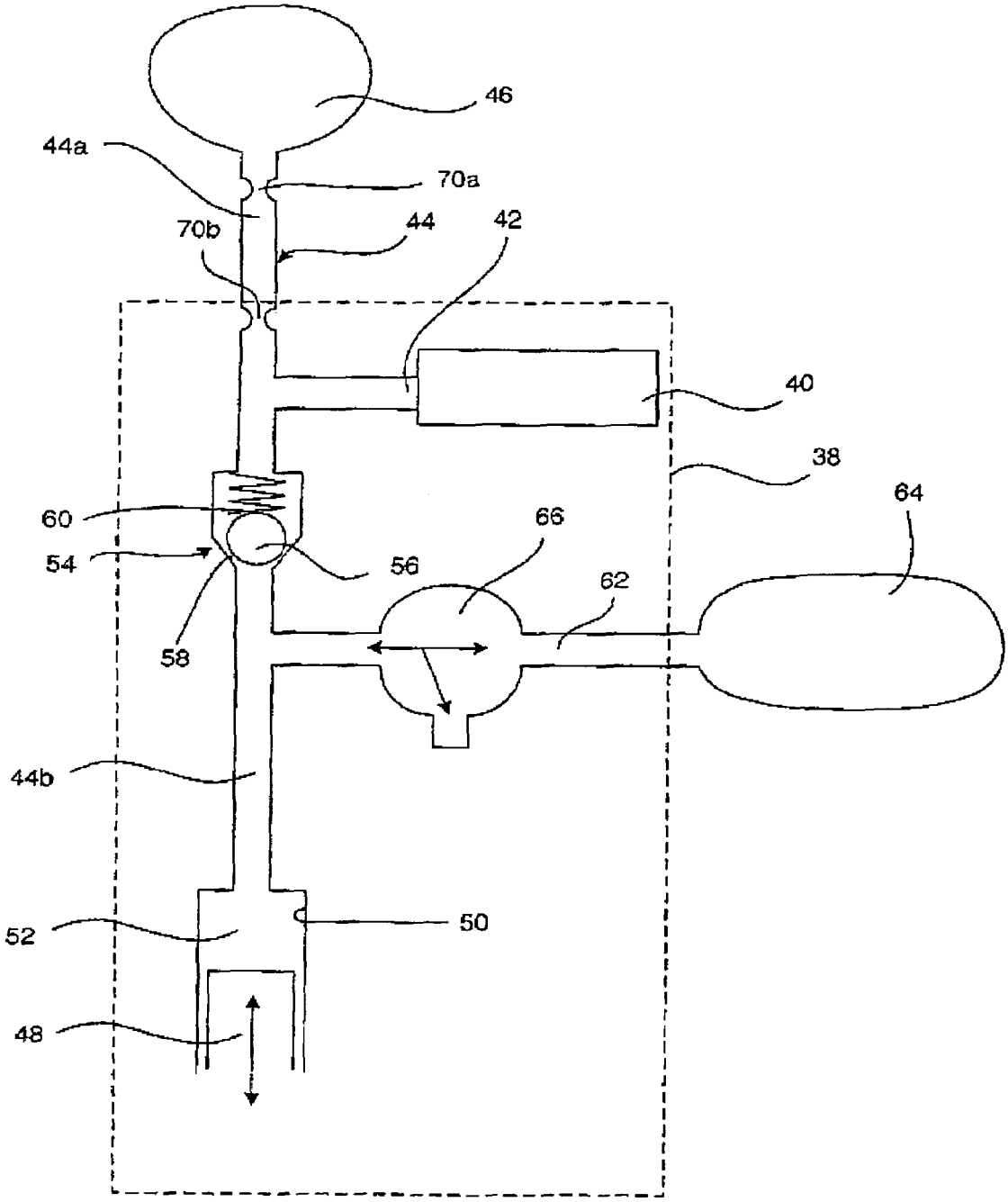
FIG. 2 is a schematic diagram of a second embodiment of the hybrid fuel injection system described in GB 0614537.9.

A second embodiment of the prior art fuel injection system of GB 0614537.9 is shown in FIG. 2, in which like reference numerals are used to denote similar parts. Here, the fuel passage 44 between the non-return valve 54 and the common rail 46 is provided with first and second orifices or restrictions 70*a*, 70*b*. The first orifice 70*a* is located at the outlet of the common rail 46 and the second orifice 70*b* is located just upstream of the point at which the fuel passage 44 feeds the injector inlet passage 42. The presence of the orifices 70*a*, 70*b* has two effects. Firstly, pressure wave effects arising within the fuel passage 44 as a result of the pumping action of the pumping plunger 48 are damped. Secondly, the orifices 70*a*, 70*b* provide a tuning mechanism to facilitate variation in injection pressure due to the variable pressure drop across the orifices 70*a*, 70*b* with engine speed (i.e. plunger speed).

A further advantage of providing an orifice or restriction in the fuel passage 44, between the points of interconnection of the fuel passage 44 with the injector inlet passage 42 and the common rail 46, is that for particularly high engine speeds (i.e. higher plunger speeds) the pressure supplied to the injector through the inlet passage 42 will be higher than fuel pressure within the common rail 46. Since the plunger 48 and the injector 40 are housed within a common housing, it is possible to locate both the pumping element of the system (i.e. the plunger 48) and the injector 40, upstream of the orifices 70*a*, 70*b*.

In alternative embodiments either one orifice only may be provided (i.e. at the location of orifice 70*a* or at the location of orifice 70*b*), or two orifices may be provided as discussed above.

An embodiment of the invention will now be described with reference to FIG. 3, in which like reference numerals to those of FIGS. 1 and 2 are used to denote similar parts.

In this embodiment, as in the prior art described above, the fuel injection system has an injector 40 (shown generally by a dashed line), which is supplied with fuel via an injector inlet passage 42. The injector inlet passage 42 receives fuel from a fuel passage 44, which communicates, at one end 44*a*, with an accumulator volume 46 in the form of a common rail. As would be understood by a person skilled in the art, the phrase common rail is not intended to be limiting and is used to describe any volume for storing fuel, whether it is elongate (i.e. a length of pipe), (part-)cylindrical, (part-)spherical or any other shape.

The injector 40 may be housed within an injector housing unit (not shown) as in the prior art. The injector 40 includes an injector valve needle 80, which is movable towards and away from an injector valve seat 81, to control the delivery of fuel from the injector 40 into the associated engine cylinder 11. To control opening and closing of the injector valve needle 80, an injector control valve 82 (not shown in detail) is provided which controls the pressure of fuel supplied to the back of the valve needle 80 (i.e. the end remote from the injector valve seat 81). The injector 40 may be electronically controlled and the injector control valve may be either a two-way valve or a three-way valve, the design and operation of which would be familiar to a person skilled in the art. By way of example, a description of an injector having a three-way injector control valve can be found in EP 1359316 (Delphi Technologies Inc.).

The fuel injection system further includes a pump arrangement 90 (shown generally by a dashed line) that may be arranged within the same housing unit as the injector 40. When the pump arrangement 90 and fuel injector 40 are within the same housing unit, the housing unit may be formed of adjacent housing parts, one of which contains the pump arrangement 90 and one of which contains the injector 40. In use, such housing parts are positionable adjacent one another within an internal combustion engine.

The pump (or pump assembly) 90 includes a pumping plunger (or plunger) 48 that is movable within a bore 50 provided in the housing unit or housing part so as to cause, in certain circumstances, pressurisation of fuel within a pump chamber 52 formed at one end of the bore 50. The pumping plunger 48 is driven by means of a drive arrangement (not shown), which includes an engine driven cam having one or more cam lobes. The pumping plunger 48 is typically driven by the cam via a roller and rocker mechanism (not shown) in a known manner. Alternatively, the plunger 48 may be driven by the cam via a guided tappet.

The pump chamber 52 communicates with a second end 44*b* of the fuel passage 44 remote from the common rail 46. A rail valve 54, suitably in the form of a non-return valve, is located within the fuel passage 44 so that the common rail 46 communicates with the pump chamber 52 via the non-return valve 54. A non-return valve as shown in this embodiment includes a ball 56, which is biased against a valve seat 58 by means of a spring 60. The biasing force of the spring 60 sets an opening pressure for the valve at which the ball 56 is caused to lift from its seat 58 to allow the pump chamber 52 to communicate with the common rail 46, and ensures that the valve remains on its seat when there is no pressure in the system. The non-return valve 54 is orientated to prevent fuel escaping undesirably from the common rail end of the fuel passage 44*a* into the pump chamber end of the fuel passage 44*b*.

A pump supply passage 62 branches from the fuel passage 44, on the pump chamber side of the non-return valve 54, and allows fuel from a low-pressure fuel reservoir 64 (located external to the housing unit), to flow into the pump chamber 52 via passages 62*a* and 62*b*. In contrast, the injector supply passage 42 branches from the fuel passage 44 on the common rail side of the non-return valve 54 (i.e. on the other side of the non-return valve 54 to the pump supply passage 62).

The pump supply passage 62 is provided with an electronically controlled inlet control valve 5 in the form of a latching inlet valve, which is operable between an open state, in which fuel is able to flow into the pump chamber 52 from the low-pressure fuel reservoir, and a closed state in which communication between the low-pressure fuel reservoir 64 and the pump chamber 52 is broken. In an advantageous form, the latching inlet valve 5 is a two-way electronic latching poppet valve.

The latching inlet valve 5 typically includes a valve stem 70, which is movable within a valve guide (or bore) 71 provided in the injector housing unit. Where, however, the pumping arrangement 90 and injector 40 are located in separate housing parts, the latching inlet valve 5 is suitably located in the same housing part as the pump 90. The valve stem 70 has a large diameter portion 70*a*, which is a sliding fit with the bore 71; and a small diameter portion 70*b* that defines a channel 74 with the bore 71 (i.e. between the outer surface of the valve stem 70*b* and the inner surface of the bore 71) for fluid communication between the pump chamber 52 and the low-pressure fuel reservoir 64 when the latching valve 5 is open. Beneficially, it is not necessary for the large diameter valve portion 70*a* to be a tight fit with the inner surface of the bore 71, because the construction of the latching inlet valve 5 means that the valve stem 70 is not, in normal operation, exposed to high-pressure, and does not, therefore, constitute a significant risk for fuel leakage.

The end of the large diameter portion of the valve stem 70*a* is provided with an armature 8 that is biased away from the latching valve stator 9 by means of a spring 7. Meanwhile the small diameter portion of the valve stem 70*b* is provided with a valve seating surface 73, in the form of a frustoconical surface on the valve head 76, which is engageable with a valve seat 72 defined by the bore 71.

When the stator 9 is energised the armature 8 at the bottom of the valve stem 70 is magnetically attracted to the stator 9, overcoming the biasing force of the spring 7 and causing the valve seating surface 73 to close against the valve seating 72. The seating surface 73 forms a sealing fit (typically in the form of an annular seating line) against the valve seat 72, and the latching inlet valve 5 is closed. In this state communication between the fuel passages 62*a* and 62*b* is prevented.

Once the stator 9 is de-energised the open or closed state of the latching valve 5 is determined by the balance between the biasing force x of the spring 7 and the force y created by the differential in fuel pressure between the fuel in the pump chamber 52 (which acts via fuel passage 62*b* on the top face 75 of the valve head 76), and the fuel in the low-pressure reservoir 64 (which acts via fuel passage 62*a* on the seating surface 73 of the valve head 76). When the fuel pressure in passage 62*b* exceeds the fuel pressure in the low-pressure reservoir 64 (i.e. in passage 62*a*) the force y acts to close the latching inlet valve 5. Thus, when y is greater than x, the latching valve 5 will be closed (irrespective of whether the stator 9 is energised), and when x exceeds y the latching valve will be opened under the biasing force of the spring 7 (when the stator 9 is de-energised). This provides an advantage over prior art fuel injection systems in that it is not necessary to energise the stator for the entire period during which the valve is closed. Thus, this system can be operated with reduced energy consumption levels compared to prior art systems.

In embodiments where the injector 40 and the pump 90 are part of a common housing unit, they can be positioned in an engine in the same way as a conventional EUI with the tip of the injector 40 (referred to as the nozzle) protruding into the associated engine cylinder in a conventional way.

In practice, a fuel injection system will include a plurality of fuel injectors, each of which is provided with its own dedicated pump arrangement in a shared housing. The system is typically provided with only one common rail so that the common rail delivers fuel to each of the injectors of the engine via respective supply passages (such as passage 44).

Figure 3:
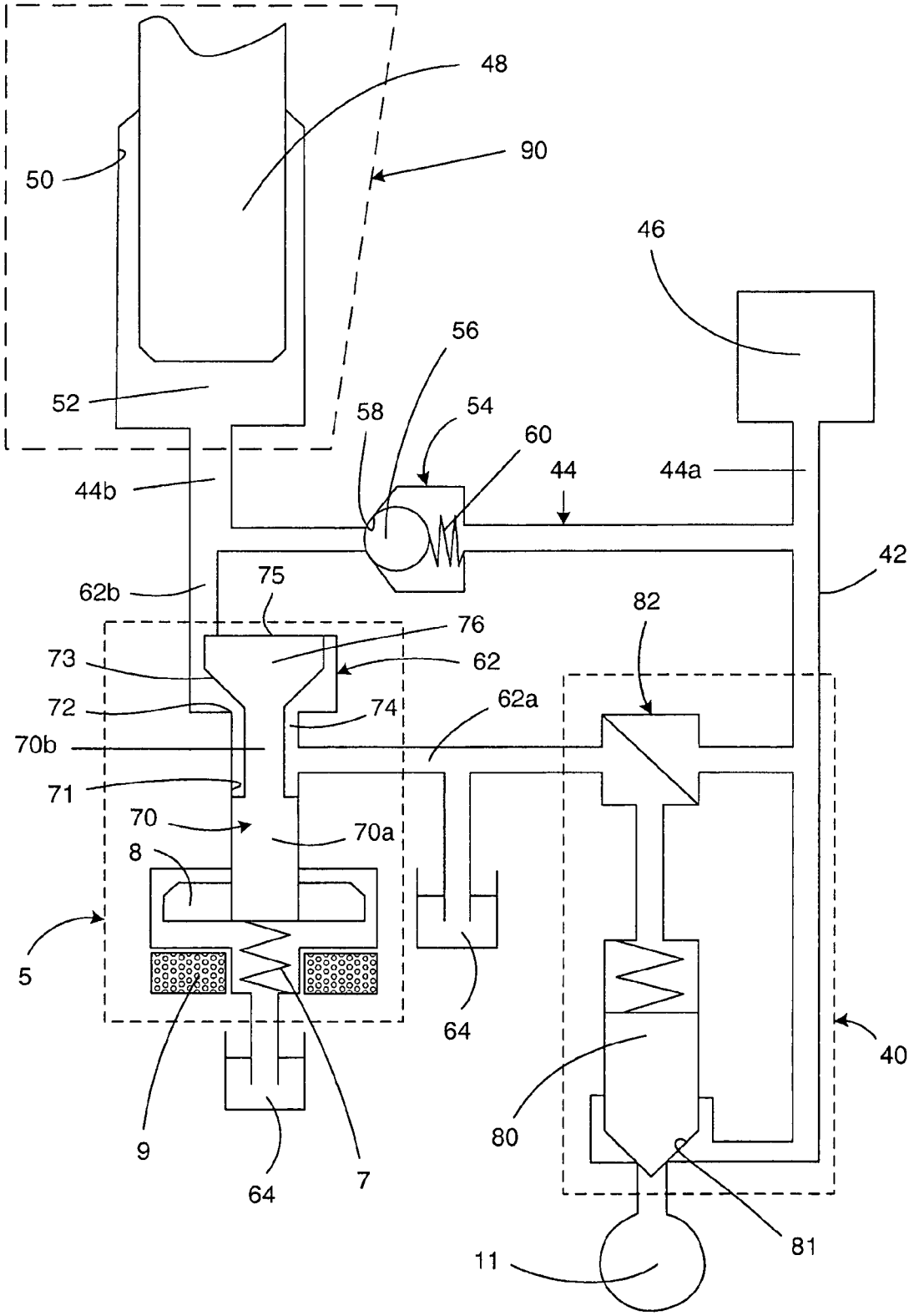
FIG. 3 shows a schematic diagram of a fuel injection system of the invention.

As described in relation to the fuel injection system shown in FIG. 2, the fuel supply passage 44 in the embodiment of FIG. 3 may be provided with first and second orifices or restrictions (not shown) in the first end 44*a* of the fuel passage 44. In such embodiments one restriction may be located close to the outlet of the common rail 46, and another restriction may be located just upstream of the point at which the fuel passage 44 feeds the injector inlet passage 42. In alternative embodiments, the fuel supply system may be provided with either one or both of the above-mentioned restrictions. The presence of the restrictions has the advantages effects described in relation to FIG. 2.

A mode of operating the fuel injection system of FIG. 3 will now be described.

As in the fuel injection systems depicted in FIGS. 1 and 2, the volume of the pump chamber 52 is determined by the axial position of the pumping plunger 48 within the bore 50; and the movement of the pumping plunger 48 is controlled by a camshaft or camshaft and rocker arm linkage within the engine.

In more detail, the pumping plunger 48 is driven to perform a pumping cycle consisting of: a return stroke, in which the pumping plunger 48 is withdrawn from the bore 50 to expand the volume of the pump chamber 52; and a pumping stroke, in which the pumping plunger 48 is driven into the bore 50 so as to reduce the volume of the pump chamber 52. At the start of the plunger return stroke (i.e. just after the end of the pumping stroke), the pumping plunger 48 is said to be at the top of its stroke and the pump chamber volume is a minimum, and at the end of its return stroke (i.e. just before the start of the pumping stroke) the pumping plunger 48 is said to be at the bottom of its stroke and the pump chamber volume is a maximum.

To pressurise and fill the common rail 46 the latching inlet valve 5 is closed at a determined point in the pumping cycle, typically during the inward pumping (or compression) stroke of the pumping plunger 48. Closure of the latching inlet valve 5 is achieved by energising stator 9, so as to generate an attractive magnetic force z on the armature 8 at the bottom of the large diameter portion 70*a* of the valve stem 70. The magnetic force z on the armature 8 is greater than the opposing biasing force x from spring 7, so that the latching inlet valve 5 closes.

Once the latching inlet valve 5 is closed, during the remainder of the pumping stroke of the pumping plunger 48, the pressure within the pump chamber 52 increases beyond the pressure of the low-pressure reservoir 64 such that there is positive force y acting against the top face 75 of the valve stem 70. The positive force y causes the seating surface 73 of the valve stem 70 to close more firmly against the valve seat 72, forming a tight seal.

During the period of the pumping cycle in which the closing force y, created by the difference in the fuel pressure between the passage 62*b* and the passage 62*a*, is greater than the biasing force x of the spring 7, the stator 9 can be de-energised and the latching inlet valve 5 will remain closed. The stator 9 can be energised at any point during this period of the pumping cycle without causing the valve to open.

In addition, when the fuel pressure within the pump chamber 52 becomes greater than the fuel pressure within the common rail 46 the non-return valve 54 in the fuel passage 44 will open and fuel will be pumped into the common rail 46. The point at which the non-return valve 54 opens is typically later than the point at which the stator 9 can be de-energised without the latching inlet valve 5 opening.

Once the plunger 48 has reached the bottom of its pumping stroke and the pumping cycle continues, it will then begin on its return stroke during which the plunger 48 retracts from the pump chamber 52. As the volume of the pump chamber 52 increases the pressure of fuel in pump chamber 52 decreases below the pressure in the common rail 46. This change in the balance of pressure causes the non-return valve 54 to close under the pressure from the common rail 46.

Simultaneously as the pressure in the pump chamber 52 drops, the force y holding the latching inlet valve 5 closed will diminish, so as to be overcome by the biasing force x of the spring 7. At this point in the return stroke of the pumping cycle the latching inlet valve 5 will open and fuel from the low-pressure reservoir 64 will be drawn into the pump chamber 52 by the continued retraction of the plunger 48. Once the plunger 48 has retracted fully, the pump chamber 52 will be completely filled with fuel from the low-pressure reservoir 64.

As a new pumping cycle commences (after a short dwell period) the motion of the pumping plunger 48 will be reversed so that, once again, the volume of the pump chamber 52 is reduced as previously described. At an appropriate point in the pumping stroke, the latching inlet valve 5 is closed to prevent further communication between the low-pressure fuel reservoir 64 and the pump chamber 52. By holding the latching inlet valve 5 open for an initial period of the plunger pumping stroke, a proportion of fuel that is drawn into the pump chamber 52 during the return stroke is dispelled through the open latching inlet valve 5, back to the low-pressure reservoir 64, before pressurisation within the pump chamber 52 commences once again.

Fuel in the common rail 46 is delivered through the fuel passage 44 to the injector inlet passage 42, and hence to the injector, but is unable to return to the pump chamber 52 due to the closed non-return valve 54. During any point of the described events the nozzle control valve 82 may be opened or closed to control delivery of fuel into the cylinder 11.

As will be appreciated by the person of skill in the art, there is no specific requirement for the seating surface 73 of the valve stem 70 to be frustoconical in shape, although this is a convenient form. Hence, in alternative embodiments of the invention, the latching inlet valve 5 may take the form of a latching ball valve, plate valve or any other suitable from of latching valve, the important feature being that the latching valve is constructed in such a manner that any positive differential in pressure between the pump chamber 52 and the low-pressure fuel reservoir 64 (i.e. when the pressure of fuel within the pump chamber is higher than the pressure of fuel in the low-pressure reservoir), creates a closing force y on the valve.

In comparison with common rail systems, when the invention is combined with the fuel injection system described in GB 0614537.9 (as exemplified in the figures), a number of advantages are achieved. First, no changes are required to engines designed for use with EUIs. Secondly, there is a hydraulic benefit because the pump chamber of the system is located relatively near to the injector (i.e. the injector is between the common rail 46 and the pump chamber 52). Thirdly, the energy requirement of the latching inlet valve that controls and/or meters the flow of fuel into the pumping arrangement is reduced. This will reduce the demand on the ECU and reduce the amount of heat generated in the stator.

It will be appreciated, however, that the EUI may be a single-valve EUI, which does not include an electronically controlled injection control valve, or it may be a two-valve EUI as indicated in FIG. 3.

The fuel injection system can be assembled into an engine in any suitable manner. By way of example, the EUIs may be clamped to the engine manifold in a conventional manner and then the common rail may be clamped to the engine manifold. The necessary pipe connections can then be assembled to connect the EUIs with the common rail. In another assembly, the EUIs may be clamped into the engine manifold in a conventional manner and then the common rail may be clamped directly to the EUIs, without the need for additional pipework. Alternatively, the combined common rail-EUI system may be clamped to the engine manifold as a single unit.

In any of the embodiments of the invention, whether those described specifically or those envisaged within the scope of the accompanying claims, the injector housing unit (not shown) for the injector 40 and the pump arrangement 90 may comprise two or more housing parts arranged adjacent to one another, rather than being a single housing part. Whether one or more housing parts are provided to form the injector/pump housing unit, the fuel injection system is conveniently arranged such that there is no need for a separate fuel pipe (or pipes) to carry fuel between the injector 40 and pump chamber 52 of the system.

In a further modification to that described previously, the non-return valve 54 need not take the form of a ball but may take an alternative valve form (for example, a plate valve).

In another embodiment the cam may be a multi-lobe cam so as to provide two or more pumping strokes per cam rotation. A multi-lobe cam is beneficial because it allows the same pressurisation capability to be achieved but with a smaller plunger diameter. It has been recognised in particular that a relatively small plunger diameter is advantageous as stresses arising in other engine components are reduced. In addition, rail pressure is more stable with a multi-lobe cam as volumetric disturbances are smaller (since a smaller plunger can be used), and torque is more stable on the camshaft.

Where alternative methods and modes of operation of the fuel injection system have been described and/or are apparent with respect to the features and components of the fuel injection system described herein, that these methods and modes of operation all fall within the scope of the methods of operation claimed herein. Moreover, where a method or mode of operation has been described with respect to a specific embodiment of a fuel injection system, that method or mode of operation is not intended to be restricted to that specific embodiment.

The invention claimed is:

1. A hybrid, electronic unit injector (EUI), common-rail fuel injection system for an internal combustion engine, the fuel injection system comprising:

a fuel injector, a pump comprising a pumping plunger which is driven, in use, to cause pressurization of fuel within a pump chamber, an accumulator volume for supplying fuel to a fuel injector, a fuel passage providing fluid communication between the pump chamber and the accumulator volume, an injector inlet passage that communicates with the fuel passage at a position between the pump chamber and the accumulator volume, and an inlet control valve operable to control fuel flow into the pump chamber from a low pressure reservoir;

wherein the inlet control valve is a latching inlet valve.

2. The fuel injection system according to claim 1, wherein the latching inlet valve is a two-way electronic latching poppet valve.

3. The fuel injection system according to claim 1, further comprising a rail valve located in the fuel passage between the pump chamber and the accumulator volume.

4. The fuel injection system according to claim 1, further comprising a rail valve located in the fuel passage between the pump chamber and the accumulator volume, and wherein the rail valve is a non-return valve.

5. The fuel injection system according to claim 1, further comprising a rail valve located in the fuel passage between the pump chamber and the accumulator volume, and wherein the fuel injector is supplied with fuel via the injector inlet passage that communicates with the fuel passage at a position between the rail valve and the accumulator volume.

6. The fuel injection system according to claim 1, wherein the fuel injector is an electronically controlled injector.

7. The fuel injection system according to claim 1, wherein the fuel injector is an electronically controlled injector, and wherein the fuel injector includes a three-way injector control valve.

8. The fuel injection system according to claim 1, wherein the fuel injector is an electronically controlled injector, and wherein the fuel injector includes a two-way injector control valve.

9. The fuel injection system according to claim 1, wherein the fuel injector, the pump and the fuel passage providing fluid communication between the pump chamber and the accumulator volume are located within the same housing unit.

10. The fuel injection system according to claim 1, wherein the fuel injector, the pump and the fuel passage providing fluid communication between the pump chamber and the accumulator volume are located within the same housing unit, and wherein the housing unit consists of two immediately adjacent housing parts, one of which housing parts contains the pump and one of which housing parts contains the fuel injector.

11. The fuel injection system according to claim 1, further comprising at least one restriction in the fuel passage.

12. The fuel injection system according to claim 1, further comprising a rail valve located in the fuel passage between the pump chamber and the accumulator volume, and wherein the fuel injector is supplied with fuel via an injector inlet passage that communicates with the fuel passage at a position between the rail valve and the accumulator volume, and further comprising at least one restriction in the fuel passage between the rail valve and the accumulator volume.

13. The fuel injection system according to claim 1, further comprising at least one restriction in the fuel passage, and wherein a restriction is located approximately at the outlet of the accumulator volume.

14. The fuel injection system according to claim 1, further comprising a rail valve located in the fuel passage between the pump chamber and the accumulator volume, wherein the fuel injector is supplied with fuel via an injector inlet passage that communicates with the fuel passage at a position between the rail valve and the accumulator volume, and wherein a restriction is located in the fuel passage immediately upstream of the point of communication between the fuel injector inlet passage and the fuel passage.

15. A method of operating a hybrid, electronic unit injector (EUI), common-rail fuel injection system for an internal combustion engine, that comprises:

a latching inlet valve that is operable to control fuel flow into a pump chamber from a low pressure reservoir and that includes an internal biasing arrangement arranged to exert an internal biasing force tending to open the latching inlet valve;

a pumping plunger for performing a pumping cycle consisting of a pumping stroke, during which the pumping plunger is driven to reduce the volume of the pump chamber, and a return stroke, during which the pumping plunger is retracted to increase the volume of the pump chamber, the method comprising:

operating a latching inlet valve so that it is open during at least a portion of the return stroke so as to allow fuel to flow from the low pressure reservoir into the pump chamber for pressurization of the pump chamber, and so that it is closed during at least a portion of the pumping stroke so as to cause pressurization of fuel within the pump chamber;

wherein to close the latching inlet valve an energy input is provided and maintained for at least a first period of the pumping stroke and the latching inlet valve remains closed after termination of the energy input for at least a second period of the pumping stroke.

16. The method according to claim 15, wherein the fuel pressure within the pump chamber is used to provide an additional closing force on the inlet control valve, and the energy input to the latching inlet valve is maintained at least until the closing force is greater than the internal biasing force tending to open the latching inlet valve.

17. The method according to claim 15, wherein the energy input is an electrical signal and the latching inlet valve is an electronic latching poppet valve.

18. The method according to claim 15, wherein the latching inlet valve is operated so that it is closed during at least a portion of the return stroke so as to reduce the pressure of fuel within the pump chamber.

19. The method according to claim 15, wherein the fuel injection system comprises:

a fuel injector, a pump comprising a pumping plunger which is driven, in use, to cause pressurization of fuel within a pump chamber, an accumulator volume for supplying fuel to a fuel injector, a fuel passage providing fluid communication between the pump chamber and the accumulator volume, and an inlet control valve operable to control fuel flow into the pump chamber from a low pressure reservoir; and wherein the inlet control valve is a latching inlet valve.

* * * * *